US008275158B2

(12) United States Patent
Kim et al.

(10) Patent No.: US 8,275,158 B2
(45) Date of Patent: Sep. 25, 2012

(54) PIEZOELECTRIC MICRO SPEAKER

(75) Inventors: Dong-kyun Kim, Suwon-si (KR); Jun-sik Hwang, Hwaseong-si (KR); Seok-whan Chung, Suwon-si (KR); Byung-gil Jeong, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 239 days.

(21) Appl. No.: 12/850,301

(22) Filed: Aug. 4, 2010

(65) Prior Publication Data

US 2011/0085684 A1 Apr. 14, 2011

(30) Foreign Application Priority Data

Oct. 12, 2009 (KR) ..... 10-2009-0096825

(51) Int. Cl.
*H04R 25/00* (2006.01)

(52) U.S. Cl. ..... 381/190

(58) Field of Classification Search ..... 381/190
See application file for complete search history.

(56) References Cited

U.S. PATENT DOCUMENTS 5,953,414 A * 9/1999 Abraham et al. ..... 379/433.02
2009/0167109 A1 7/2009 Tomita et al.

FOREIGN PATENT DOCUMENTS

JP 06086387 A * 3/1994
JP 2005-295364 A 10/2005
JP 2006-165701 A 6/2006
JP 2006-303675 A 11/2006
KR 10-2009-0059756 A 6/2009

* cited by examiner

*Primary Examiner* — Ramon Barrera
(74) *Attorney, Agent, or Firm* — Sughrue Mion, PLLC

(57) ABSTRACT

Provided is a piezoelectric micro speaker. The piezoelectric micro speaker includes a device plate having a front cavity, a front plate having a radiation hole which communicates with the front cavity in front of the device plate, and a rear plate having a rear cavity and a vent portion. A rear portion of the device plate forms a wall of the vent portion. The device plate includes at least one first vent hole which communicates with the vent portion, and the front plate includes at least one second vent hole which communicates with the first vent hole.

11 Claims, 7 Drawing Sheets

PIEZOELECTRIC MICRO SPEAKER

CROSS-REFERENCE TO RELATED APPLICATIONS

This application claims priority from Korean Patent Application No. 10-2009-0096825, filed on Oct. 12, 2009, in the Korean Intellectual Property Office, the disclosure of which is incorporated herein in its entirety by reference.

BACKGROUND

1. Field

On or more embodiments relate to a piezoelectric micro speaker, and more particularly, to a piezoelectric micro speaker which may be mounted on a surface of an electronic device.

2. Description of the Related Art

Due to rapid development of terminals for personal voice communications and data communications, amounts of data to be transmitted and received has increased, while the terminals are required to be small and multifunctional.

In response to these trends, research into acoustic devices using micro-electro-mechanical system (MEMS) technology has been conducted. In particular, MEMS technology and semiconductor technology make it possible to manufacture micro speakers with small size and low costs according to a package process and to easily integrate micro speakers with peripheral circuits.

Speakers using MEMS technology can be classified into electrostatic type micro speakers, electromagnetic type micro speakers, and piezoelectric type micro speakers. Piezoelectric type micro speakers can be driven at lower voltages than electrostatic type micro speakers, and have simpler and slimmer structures than the electromagnetic type micro speakers.

A piezoelectric micro speaker includes a piezoelectric actuator placed on a surface of a diaphragm. The piezoelectric actuator includes two electrode layers and a piezoelectric layer therebetween. When the piezoelectric micro speaker is mounted on a surface of an electronic device, the acoustic characteristics of the micro speaker may change due to a too short or not constant distance between a vent hole formed in a rear surface of the piezoelectric micro speaker and a surface of a printed circuit board (PCB) where the micro speaker is mounted.

SUMMARY

Provided is a piezoelectric micro speaker having consistent acoustic characteristics even when the piezoelectric micro speaker is mounted on a PCB.

Additional aspects will be set forth in part in the description which follows and, in part, will be apparent from the description, or may be learned by practice of the presented embodiments.

According to one or more embodiments, a piezoelectric micro speaker includes: a device including a device plate having a front cavity therein, a diaphragm disposed on a rear surface of the device plate and overlapping the front cavity, and a piezoelectric actuator disposed on a rear surface of the diaphragm; a front plate disposed on a front surface of the device plate, the front plate including a radiation hole which communicates with the front cavity; and a rear plate disposed on a rear surface of the device plate, the rear plate including a rear cavity formed in a front surface of the rear plate, and a vent portion which is a space which communicates with the rear cavity, wherein the device plate includes at least one first vent hole which communicates with the vent portion, and the front plate includes at least one second vent hole which communicates with the at least one first vent hole.

The at least one first vent hole may be separated from the front cavity, and the at leas tone second vent hole may be separated from the radiation hole.

The rear plate may have a substantially square outer circumference and the vent portion may extend along a side of the rear plate.

The piezoelectric actuator may include a first electrode layer and a second electrode layer. First and second via holes may be formed in opposite corners of the rear plate, a first conductive plug, connected to the first electrode layer of the piezoelectric actuator, may be filled in the first via hole, and a second conductive plug, connected to the second electrode layer of the piezoelectric actuator, may be formed in the second via hole.

The at least one first vent hole may be a slit extending along the side of the rear plate.

The rear plate may have a square shape, and the vent portion may be formed on a corner of the rear plate.

According to one or more embodiments, a piezoelectric micro speaker includes: a device including a device plate having a front cavity therein, a diaphragm disposed on a rear surface of the device plate overlapping the front cavity, and a piezoelectric actuator disposed on a rear surface of the diaphragm; a front plate disposed on a front surface of the device plate, the front plate including a radiation hole which communicates with the front cavity; a rear plate disposed on a rear surface of the device plate, the rear plate including a rear cavity formed in a front surface of the rear plate; and at least one vent hole which penetrates through a side surface of the micro speaker and which communicates with the rear cavity.

The rear plate may have a substantially square outer circumference, and the at least one vent hole may be a hole along a side surface of the rear plate, wherein a lower surface of the device plate may form an upper wall of the vent hole.

The rear plate may have a substantially square outer circumference, and the at least one vent hole may be formed in side surface of the rear plate.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
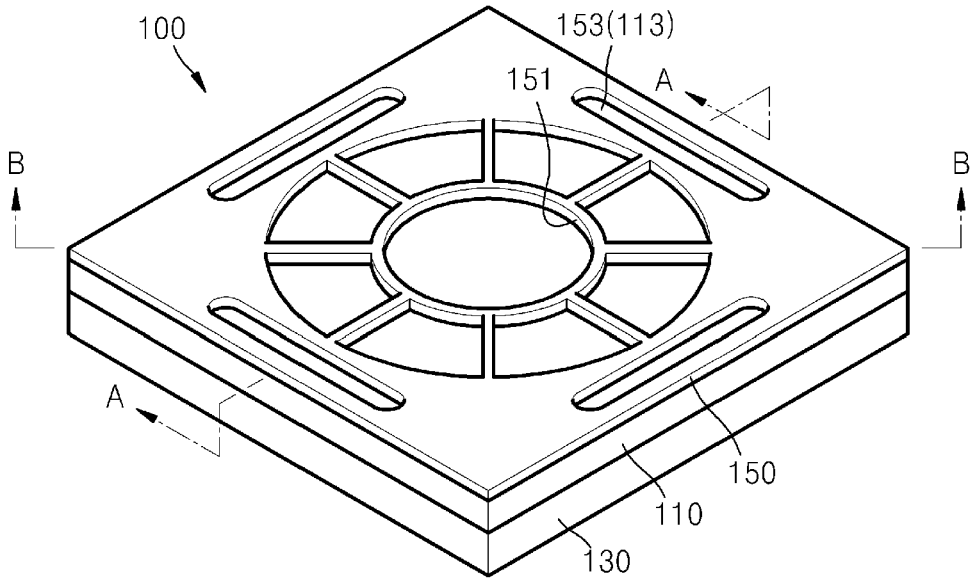
FIG. 1 is a perspective view of a piezoelectric micro speaker according to an embodiment.

Reference will now be made in detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the present description.

Figure 2:
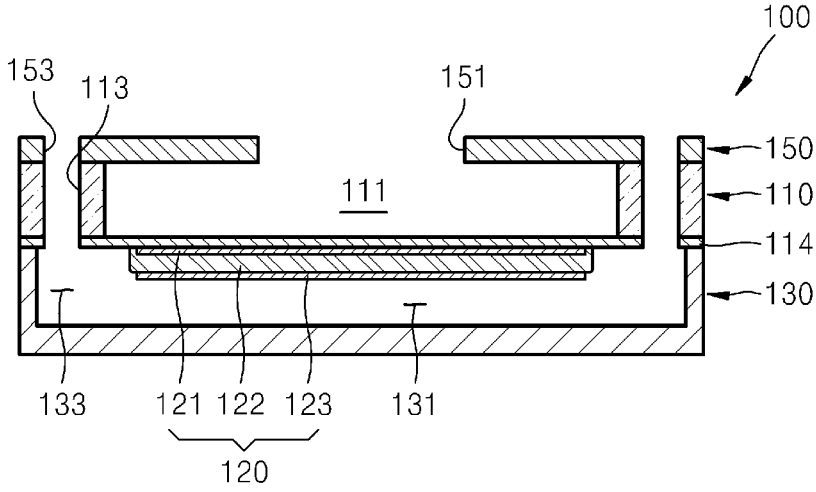
FIG. 2 is a cross-sectional view of the piezoelectric micro speaker taken along line A-A of FIG. 1.
Figure 3:
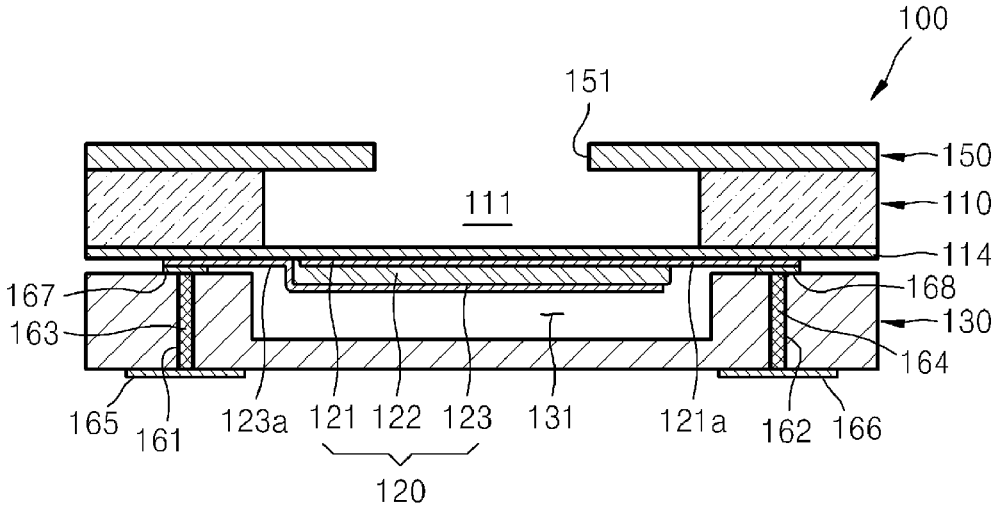
FIG. 3 is a cross-sectional view of the piezoelectric micro speaker taken along line B-B of FIG. 1.

FIG. 1 is a perspective view of a piezoelectric micro speaker 100 according to an embodiment, FIG. 2 is a cross-sectional view of the piezoelectric micro speaker 100, taken along line A-A of FIG. 1, and FIG. 3 is a cross-sectional view of the piezoelectric micro speaker 100, taken along line B-B of FIG. 1.

Referring to FIGS. 1 through 3, the piezoelectric micro speaker 100 includes a device plate 110, a rear plate 130 bonded to a rear surface of the device plate 110, and a front plate 150 bonded to a front surface of the device plate 110. The device plate includes a diaphragm 114 and a piezoelectric actuator 120, and the front plate 150 includes a radiation hole 151 for radiating sound.

Figure 4:
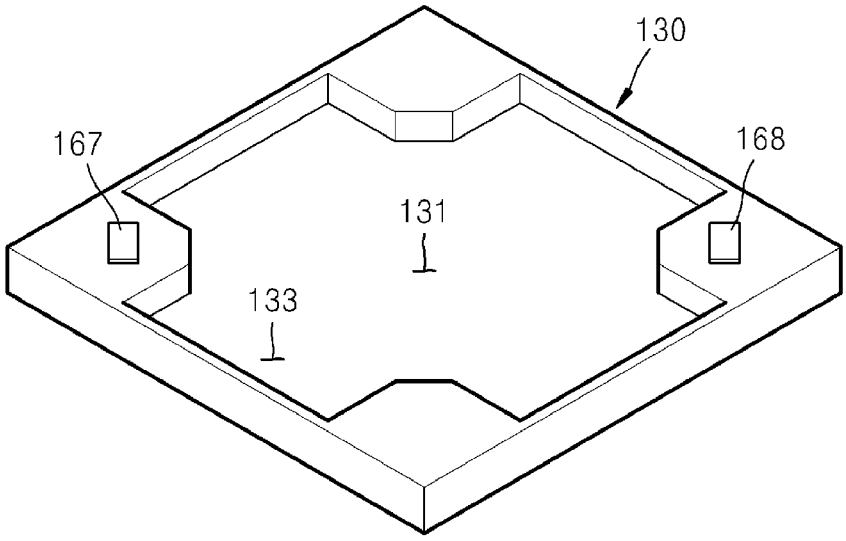
FIG. 4 is a partial perspective view of a rear plate in the piezoelectric micro speaker of FIG. 1.

FIG. 4 is a partial perspective view of the rear plate 130. Referring to FIG. 4, the rear plate 130 includes a rear cavity 131 for allowing a vibration space for the diaphragm 114 and the piezoelectric actuator 120, and a vent portion 133 for limiting damping and tuning acoustic characteristics.

The vent portion 133 extends from the rear cavity 131 toward a side surface of the rear plate 130, and is connected to vent holes 113 and 153 which will be described later. The vent portion 133 is formed along with sides of the rear plate 130. The bottom surface of the device plate 110 or a bottom surface of the diaphragm forms the upper interior surface of the vent portion 133. The rear plate 130 may have a square shape.

The diaphragm 114 has a predetermined thickness and the piezoelectric actuator 120 is disposed on a surface of the diaphragm 114 facing the rear cavity 131. The piezoelectric actuator 120 may have a circular shape. The piezoelectric actuator 120 includes a first electrode layer 121 disposed on the diaphragm 114, a piezoelectric layer 122 disposed on the first electrode layer 121, and a second electrode layer 123 disposed on the piezoelectric layer 122. The device plate 110 may be formed of a silicon wafer. The diaphragm 114 may be formed of a silicon nitride, for example, $Si_3N_4$, deposited to a predetermined thickness on the surface of the device plate 110. The first electrode layer 121 and the second electrode layer 123 may be formed of a conductive metal, and the piezoelectric layer 122 may be formed of a piezoelectric material, for example, zinc oxide (ZnO).

The device plate 110 includes a front cavity 111. The front cavity 111 provides a space in a front portion of the diaphragm 114 in order to allow vibrations of the diaphragm 114 and the piezoelectric actuator 120 so that sound is generated due to the vibration of the diaphragm 114.

In the device plate 110, when a certain voltage is applied to the piezoelectric layer 122 via the first and second electrode layers 121 and 123, the piezoelectric layer 122 is deformed. Accordingly, the diaphragm 114 vibrates and sound is generated due to the vibration of the diaphragm 114. The sound is radiated frontward through the front cavity 111 of the device plate 110 and backward to the rear cavity 131.

The device plate 110 includes at least one first vent hole 113 which is connected to the vent portion 133. The first vent hole 113 is separated from the front cavity 111. The first vent hole 113 is a slit extending along a side wall of the device plate 110. In the embodiment of FIG. 1, four first vent holes 113 are included in the device plate 110 but embodiments are not limited thereto.

The front plate 150 is bonded to the front surface of the device plate 110, and may be formed of a silicon wafer. The front plate 150 includes the radiation hole 151 for radiating the sound, and at least one second vent hole 153. The radiation hole 151 is formed to be connected to the front cavity 111 which is formed in the device plate 110. The second vent hole 153 is a slit extending along the side wall of the front plate 150. In the embodiment of FIG. 1, four second vent holes 153 are included in the front plate 150 but embodiments are not limited thereto.

The second vent hole 153 is connected to the first vent hole 113 and the vent portion 133, and is separated from the radiation hole 151. The sound generated by the piezoelectric actuator 120 in the rear cavity 131 is radiated via the vent portion 133, the first vent hole 113, and the second vent hole 153.

Referring to FIGS. 3 and 4, via holes 161 and 162 are formed in opposite corners of the rear plate 130, and conductive plugs 163 and 164 are filled in the via holes 161 and 162, respectively. Lower electrode pads 165 and 166 are formed on lower portions of the conductive plugs 163 and 164, and upper electrode pads 167 and 168 are formed on upper portions of the conductive plugs 163 and 164. The lower electrode pads 165 and 166 electrically connect the piezoelectric micro speaker 100 to a PCB where the piezoelectric micro speaker 100 is mounted, and may be connected to the PCB via solder balls.

Figure 5:
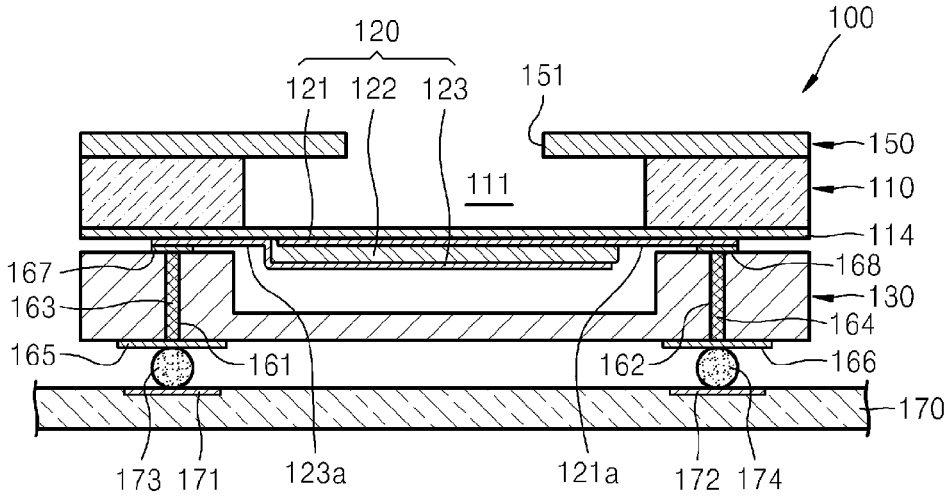
FIG. 5 is a cross-sectional view of the piezoelectric micro speaker of FIG. 1 that is installed on a PCB of an electronic device.

FIG. 5 is a cross-sectional view of the piezoelectric micro speaker 100 of FIG. 1 installed on a PCB 170 of an electronic device. Driving electrode pads 171 and 172 are formed on the PCB 170 for driving the piezoelectric micro speaker 100. The driving electrode pads 171 and 172 are electrically connected to the second electrode layer 123 and the first electrode layer 121 via solder balls 173 and 174, respectively.

In FIG. 3, a wire 121*a* extending from the first electrode layer 121 toward a right side is connected to the upper electrode pad 168. A wire 123*a* extending from the second electrode layer 123 to a left side is connected to the upper electrode pad 167. Thus, a voltage can be applied to the lower electrode pads 165 and 166 in order to apply the voltage to the first and second electrode layers 121 and 123 from an outer portion of the piezoelectric micro speaker 100.

The rear plate 130 may be formed of a silicon wafer, and the upper electrode pads 167 and 168 and the lower electrode pads 165 and 166 may be formed of a conductive metal, for example, chrome and/or gold. The conductive plugs 163 and 164 are formed of a conductive metal, for example, copper. In particular, the upper electrode pads 167 and 168 and the lower electrode pads 165 and 166 may have double-layered structures in which chrome and gold are stacked.

The rear plate 130 is bonded to the rear surface of the device plate 110, and the front plate 150 is bonded to the front surface of the device plate 110. The rear plate 130 and the device plate 110 may be bonded to each other by using a conductive metal compound or polymer. The front plate 150 and the device plate 110 may be bonded to each other by using the conductive metal compound or polymer.

According to the piezoelectric micro speaker 100 of the present embodiment, since the vent holes are formed in the front surface of the micro speaker 100, not in the rear surface of the micro speaker 110, the acoustic characteristics of the micro speaker 100 do not change due to a thickness of a bonding portion (solder balls) when the micro speaker 100 is mounted on the PCB 170. That is, the acoustic characteristics may be consistently maintained without regard to the mounting conditions of the micro speaker 100.

Figure 6:
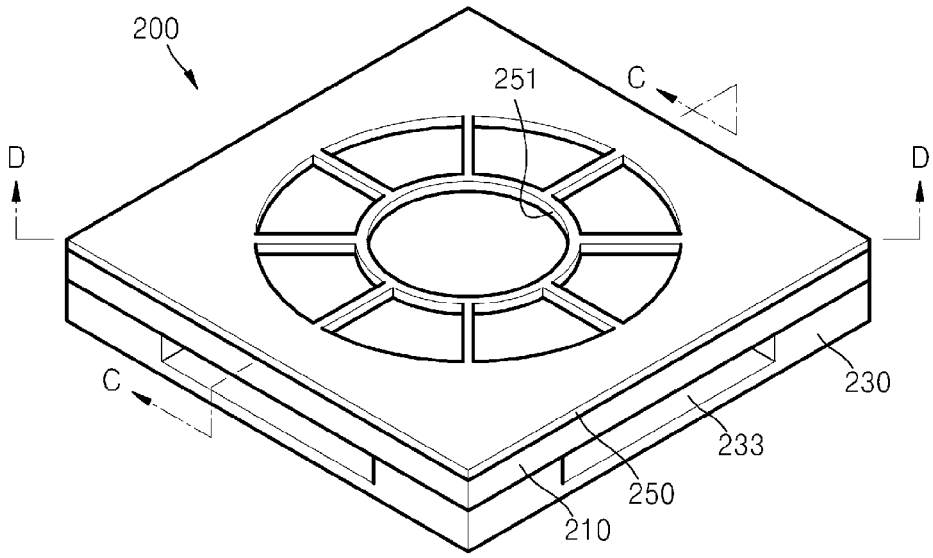
FIG. 6 is a perspective view of a piezoelectric micro speaker according to another embodiment.
Figure 7:
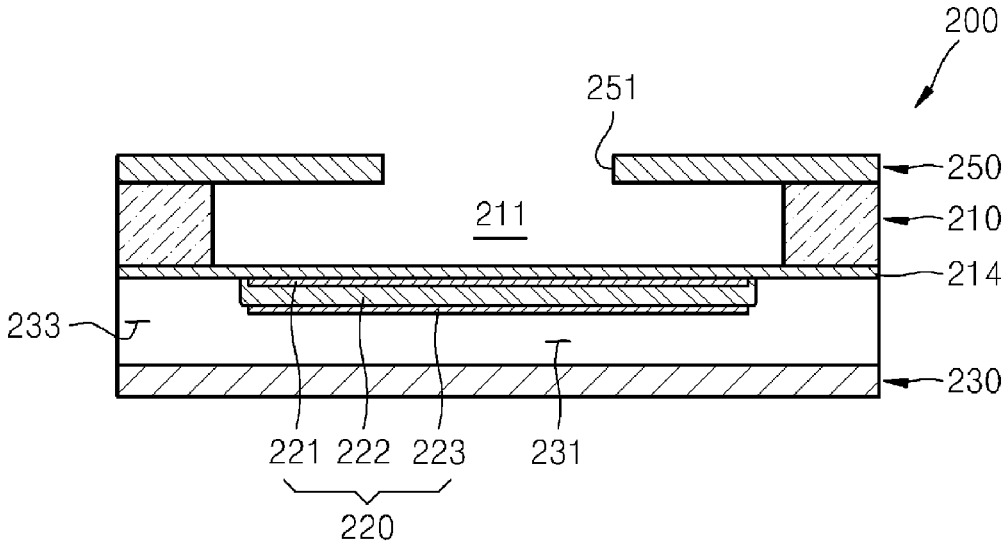
FIG. 7 is a cross-sectional view of the piezoelectric micro speaker of FIG. 6, taken along line C-C of FIG. 6.
Figure 8:
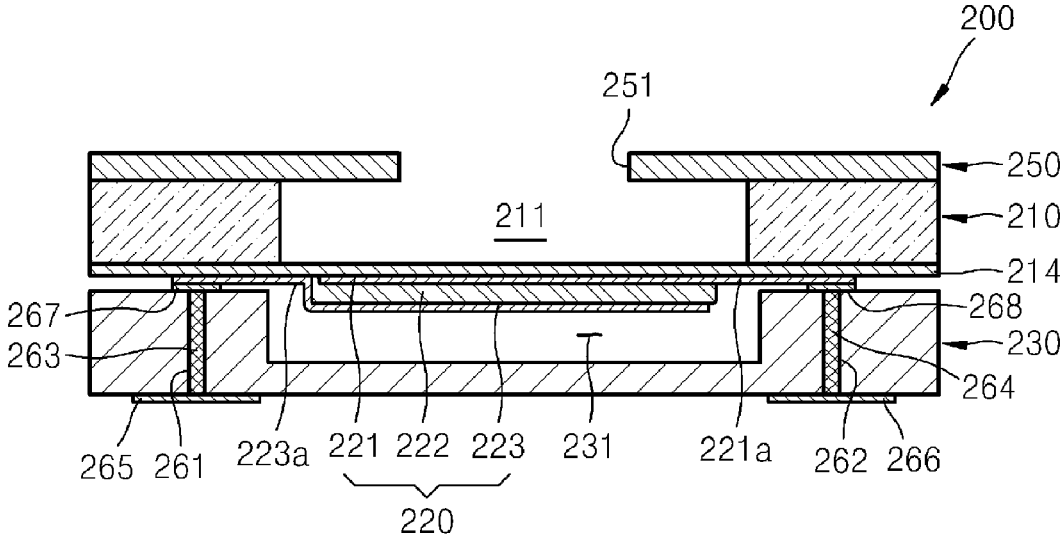
FIG. 8 is a cross-sectional view of the piezoelectric micro speaker of FIG. 6, taken along line D-D of FIG. 6.

FIG. 6 is a perspective view of a piezoelectric micro speaker 200 according to another embodiment, FIG. 7 is a cross-sectional view of the piezoelectric micro speaker 200, taken along line C-C of FIG. 6, and FIG. 8 is a cross-sectional view of the piezoelectric micro speaker taken 200, along line D-D of FIG. 6. Like elements as in the previous embodiment are denoted by the like reference numerals, and detailed descriptions of those elements are not provided.

Referring to FIGS. 6 through 8, the piezoelectric micro speaker 200 includes a device plate 210 including a diaphragm 214 and a piezoelectric actuator 220, a rear plate 230 bonded to a rear surface of the device plate 210, and a front plate 250 bonded to a front surface of the device plate 210 and including a radiation hole 251 for radiating sound.

The rear plate 230 includes a rear cavity 231 providing a space allowing vibrations of the diaphragm 214 and the piezoelectric actuator 220, and at least one vent hole 233 for limiting damping and tuning the acoustic characteristics. In the embodiment of FIG. 6, four vent holes 233 are included in the rear plate 230 but embodiments are not limited thereto.

The vent hole 233 extends from the rear cavity 231 toward a side portion of the micro speaker 200, and forms a side hole with a bottom surface of the device plate 210. The vent hole 233 is formed along sides of the rear plate 230, which has a square shape, and contacts the bottom surface of the device plate 210. The sound generated by the piezoelectric actuator 220 in the rear cavity 231 is radiated to outside of the micro speaker 200 via the vent hole 233.

The diaphragm 214 has a predetermined thickness and is mounted on a surface of the device plate 210, and the piezoelectric actuator 220 is disposed on a surface of the diaphragm 214 facing the rear cavity 231. The piezoelectric actuator 220 may have a circular shape. The piezoelectric actuator 220 includes a first electrode layer 221 disposed on the diaphragm 214, a piezoelectric layer 222 disposed on the first electrode layer 221, and a second electrode layer 223 disposed on the piezoelectric layer 222. A front cavity 211 is formed in the device plate 210.

The front plate 250 is bonded to the front surface of the device plate 210. The front plate 250 includes a radiation hole 251 for radiating sound. The radiation hole 251 is connected to the front cavity 211 formed in the device plate 210.

Via holes 261 and 262 are formed in opposite corners of the rear plate 230, and conductive plugs 263 and 264 are filled in the via holes 261 and 262, respectively. Lower electrode pads 265 and 266 are formed on lower portions of the conductive plugs 263 and 264, and upper electrode pads 267 and 268 are formed on upper portions of the conductive plugs 263 and 264. The lower electrode pads 265 and 266 are electrically connected to a PCB, on which the piezoelectric micro speaker 200 will be mounted, and may be connected to the PCB via solder balls.

Referring to FIG. 8, a wire 221*a* extending from the first electrode layer 221 toward a right side is connected to the upper electrode pad 268. A wire 223*a* extending from the second electrode layer 223 to a left side is connected to the upper electrode pad 267. Thus, a voltage can be applied to the lower electrode pads 265 and 266 in order to apply the voltage to the first and second electrode layers 221 and 223 from an outer portion of the piezoelectric micro speaker 200.

The rear plate 230 is bonded to the rear surface of the device plate 210, and the front plate 250 is bonded to the front surface of the device plate 210.

Figure 9:
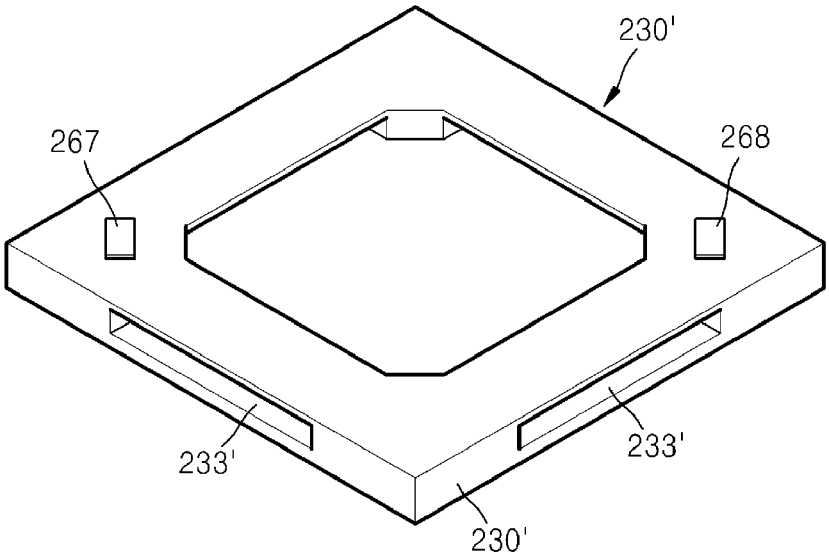
FIG. 9 is a partial perspective view of a modified example of the piezoelectric micro speaker shown in FIG. 6.

In the present embodiment illustrated in FIGS. 6 through 8, the lower surface of the device plate 210, or the lower surface of the diaphragm 214 disposed on the device plate 210, forms the upper interior wall of the vent hole 233, however, embodiments are not limited thereto. For example, as shown in a modified example of FIG. 9, a vent hole 233' may be formed through a side surface of a rear plate 230'.

According to the piezoelectric micro speaker of the present embodiment, since the vent hole is not formed in the rear surface of the micro speaker 200, but in the side surface of the micro speaker 200, the acoustic characteristics do not vary with a thickness of the bonding portion (solder balls) when the micro speaker 200 is mounted on the PCB. That is, the acoustic characteristics may be consistently maintained irrespective of the mounting condition of the micro speaker 200.

Figure 10:
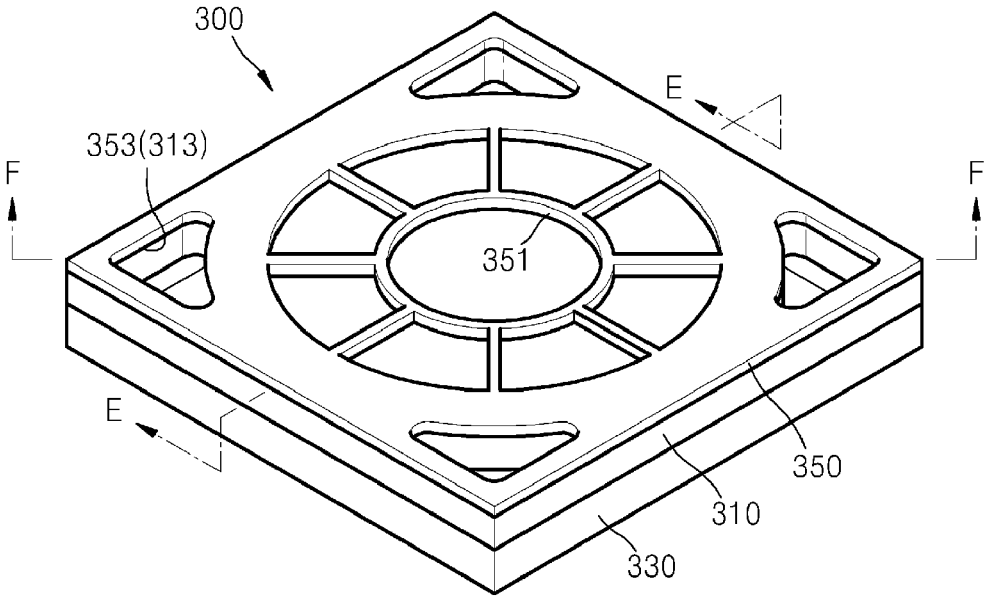
FIG. 10 is a schematic perspective view of a piezoelectric micro speaker according to still another embodiment.
Figure 11:
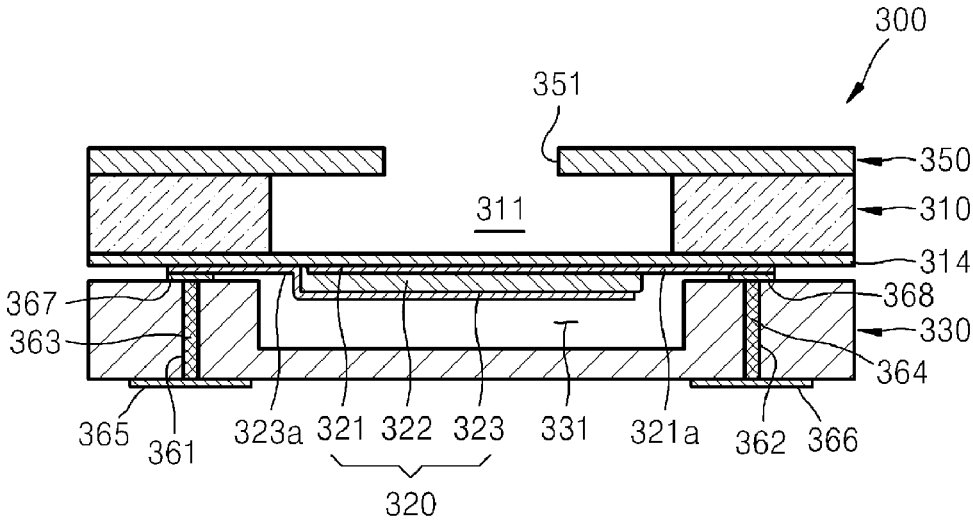
FIG. 11 is a cross-sectional view of the piezoelectric micro speaker of FIG. 10, taken along line E-E of FIG. 10.
Figure 12:
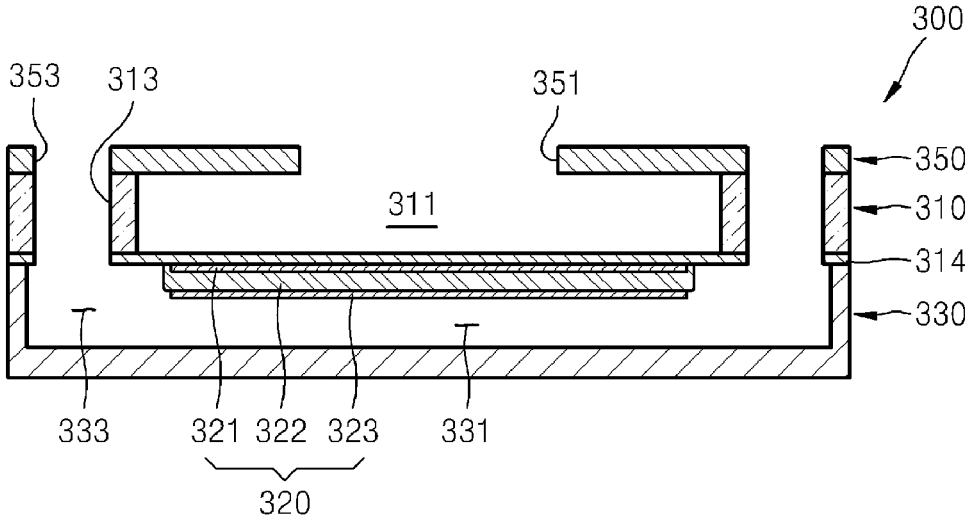
FIG. 12 is a cross-sectional view of the piezoelectric micro speaker taken of FIG. 10, along line F-F of FIGS. 10.

FIG. 10 is a schematic perspective view of a piezoelectric micro speaker 300 according to still another embodiment, FIG. 11 is a cross-sectional view of the piezoelectric micro speaker of FIG. 10, taken along line E-E of FIG. 10, and FIG. 12 is a cross-sectional view of the piezoelectric micro speaker of FIG. 10, taken along line F-F of FIG. 10. Like elements as in the previous embodiment are denoted by like reference numerals, and detailed descriptions of those elements are not provided.

Referring to FIGS. 10 through 12, a piezoelectric micro speaker 300 includes a device plate 310 having a diaphragm 314 and a piezoelectric actuator 320, a rear plate 330 bonded to a rear surface of the device plate 310, and a front plate 350 bonded to a front surface of the device plate 310 and including a radiation hole 351 for radiating sound.

The diaphragm 314 having a predetermined thickness is placed on a surface of the device plate 310, and the piezoelectric actuator 320 is disposed on a surface of the diaphragm 314. The piezoelectric actuator 320 may have a circular shape. The piezoelectric actuator 320 includes a first electrode layer 321 disposed on the diaphragm 314, a piezoelectric layer 322 disposed on the first electrode layer 321, and a second electrode layer 323 disposed on the piezoelectric layer 322.

Figure 13:
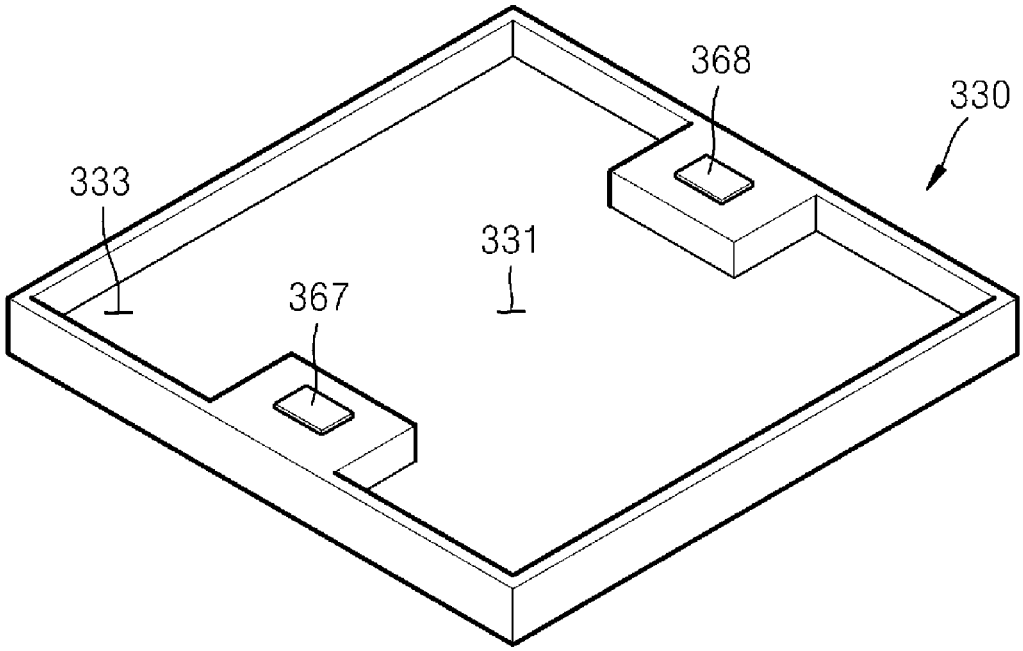
FIG. 13 is a partial perspective view of a rear plate in the piezoelectric micro speaker of FIG. 10.

FIG. 13 is a partial perspective view of the rear plate 330. Referring to FIG. 13, the rear plate 330 includes a rear cavity 331 providing a space for allowing vibrations of the diaphragm 314 and the piezoelectric actuator 320, and a vent portion 333 for limiting damping and tuning acoustic characteristics. The vent portion 333 extends from the rear cavity 331 toward a corner of the rear plate 330, and is connected to vent holes 313 and 353 which will be described later. Reference numerals 367 and 368 denote upper electrode pads.

The device plate 310 includes a front cavity 311. The front cavity 311 provides a space at a front portion of the diaphragm 314 that allows vibrations of the diaphragm 314 and the piezoelectric actuator 320 so that sound can be generated by the vibration of the diaphragm 314.

The device plate 310 includes at least one first vent hole 313 which is connected to the vent portion 333. The first vent hole 313 is separated from the front cavity 311, and is formed in a corner of the device plate 310 having a square shape. In the embodiment of FIG. 10, four first vent holes 113 are included in the device plate 310 but embodiments are not limited thereto.

The front plate 350 is bonded to the front surface of the device plate 310. The front plate 350 includes a radiation hole 351 and at least one second vent hole 353 for radiating the sound. In the embodiment of FIG. 10, four second vent holes 353 are included in the front plate 350 but embodiments are not limited thereto. The radiation hole 351 is connected to the front cavity 311 formed in the device plate 310. The second vent hole 353 is formed in a corner of the front plate 350 having a square shape. The second vent hole 353 is connected to the first vent hole 313 and the vent portion 333, and is separated from the radiation hole 351. The sound generated by the piezoelectric actuator 320 in the rear cavity 331 is radiated via the vent portion 333, the first vent hole 313, and the second vent hole 353.

Via holes 361 and 362 are formed in opposite sides of the rear plate 330, and conductive plugs 363 and 364 are filled in the via holes 361 and 362. Lower electrode pads 365 and 366 are formed on lower portions of the conductive plugs 363 and 364, and the upper electrode pads 367 and 368 are formed on upper portions of the conductive plugs 363 and 364, respectively. The lower electrode pads 365 and 366 are electrically connected to a PCB, on which the piezoelectric micro speaker 300 will be mounted, and may be connected to the PCB via solder balls.

Referring to FIG. 11, a wire 321*a* extending from the first electrode layer 321 toward a right side is connected to the upper electrode pad 368. A wire 323*a* extending from the second electrode layer 323 to a left side is connected to the upper electrode pad 367. Thus, a voltage can be applied to the lower electrode pads 365 and 366 in order to apply the voltage to the first and second electrode layers 321 and 323 from an outer portion of the piezoelectric micro speaker 300.

According to the piezoelectric micro speaker of the present embodiment, the vent hole may be formed in the side surface or the front surface of the micro speaker 300, and accordingly, the acoustic characteristics may be consistently maintained irrespective of the mounting condition of the micro speaker 300 when the micro speaker 300 is mounted on a surface of the electronic device.

It should be understood that the embodiments described herein should be considered in a descriptive sense only and not for purposes of limitation. Descriptions of features or aspects within each embodiment should typically be considered as available for other similar features or aspects in other embodiments.

What is claimed is:

1. A piezoelectric micro speaker comprising:

a device comprising:

a device plate comprising a front cavity therein, a diaphragm disposed on a rear surface of the device plate overlapping the front cavity, and a piezoelectric actuator disposed on a rear surface of the diaphragm;

a front plate disposed on a front surface of the device plate, the front plate comprising a radiation hole which communicates with the front cavity; and a rear plate disposed on a rear surface of the device, the rear plate comprising a rear cavity formed in a front surface of the rear plate, and a vent portion which is a space which communicates with the rear cavity, wherein the device plate further comprises at least one first vent hole which communicates with the vent portion, and the front plate further comprises at least one second vent hole which communicates with the at least one first vent hole.

2. The piezoelectric micro speaker of claim 1, wherein the at least one first vent hole is separated from the front cavity, and the at least one second vent hole is separated from the radiation hole.

3. The piezoelectric micro speaker of claim 1, wherein the rear plate has a substantially square outer circumference and the vent portion extends along a side of the rear plate.

4. The piezoelectric micro speaker of claim 3, wherein the piezoelectric actuator comprises a first electrode layer and a second electrode layer, and wherein the rear plate further comprises:

a first via hole and a second via hole formed in opposite corners of the rear plate, a first conductive plug disposed in the first via hole and connected to the first electrode layer of the piezoelectric actuator, and a second conductive plug disposed in the second via hole and connected to the second electrode layer of the piezoelectric actuator.

5. The piezoelectric micro speaker of claim 3, wherein the at least one first vent hole is a slit extending along the side of the rear plate.

6. The piezoelectric micro speaker of claim 1, wherein the rear plate has a substantially square outer circumference, and the vent portion is formed on a corner of the rear plate.

7. The piezoelectric micro speaker of claim 6, wherein the piezoelectric actuator comprises a first electrode layer and a second electrode layer, and wherein the rear plate further comprises:

a first via hole and a second via hole formed in opposite sides of the rear plate, a first conductive plug disposed in the first via hole and connected to the first electrode layer of the piezoelectric actuator, and a second conductive plug disposed in the second via hole and connected to the second electrode layer of the piezoelectric actuator.

8. A piezoelectric micro speaker comprising:

a device comprising:

a device plate comprising a front cavity therein, a diaphragm disposed on a rear surface of the device plate overlapping the front cavity, and a piezoelectric actuator disposed on a rear surface of the diaphragm;

a front plate disposed on a front surface of the device plate, the front plate comprising a radiation hole which communicates with the front cavity;

a rear plate disposed on a rear surface of the device, the rear plate comprising a rear cavity formed in a front surface of the rear plate; and at least one vent hole which penetrates through a side surface of the micro speaker and which communicates with the rear cavity.

9. The piezoelectric micro speaker of claim 8, wherein the rear plate has a substantially square outer circumference, and the at least one vent hole comprises a hole along a side surface of the rear plate, wherein a lower surface of the device forms an upper wall of the vent hole.

10. The piezoelectric micro speaker of claim 8, wherein the piezoelectric actuator comprises a first electrode layer and a second electrode layer, and wherein the rear plate further comprises:

a first via hole and a second via hole formed therethrough in opposite corners of the rear plate, a first conductive plug disposed in the first via hole and connected to a first electrode of layer of the piezoelectric actuator, and a second conductive plug disposed in the second via hole and connected to a second electrode layer of the piezoelectric actuator.

11. The piezoelectric micro speaker of claim 8, wherein the rear plate has a substantially square outer circumference, and the at lease one vent hole is a hole through a side surface of the rear plate.

* * * * *